United States Patent [19]

Budzich

[11] 4,122,865

[45] Oct. 31, 1978

[54] LOAD RESPONSIVE FLUID CONTROL VALVE

[76] Inventor: Tadeusz Budzich, 80 Murwood Dr., Moreland Hills, Ohio 44022

[21] Appl. No.: 773,421

[22] Filed: Feb. 28, 1977

Related U.S. Application Data

[63] Continuation-in-part of Ser. No. 729,696, Oct. 5, 1976, Pat. No. 4,028,889, and Ser. No. 655,561, Feb. 5, 1976.

[51] Int. Cl.[2] ..... F15B 13/02

[52] U.S. Cl. ..... 137/596.13; 60/445; 91/421; 91/446; 137/596.1

[58] Field of Search ..... 60/427, 445; 91/412, 91/421, 436, 446; 137/596.12, 596.13, 596.1

[56] References Cited

U.S. PATENT DOCUMENTS

| | | | |
|---|---|---|---|
| 3,807,447 | 4/1974 | Masuda | 137/596.13 |
| 3,882,896 | 5/1975 | Budzich | 137/596.1 |
| 3,984,979 | 10/1976 | Budzich | 60/445 |
| 4,028,889 | 6/1977 | Budzich | 137/596.12 X |

*Primary Examiner*—Gerald A. Michalsky

[57] ABSTRACT

A direction flow control valve for control of positive and negative loads equipped with a load responsive positive load control which automatically regulates valve inlet pressure to maintain a relatively constant pressure differential between inlet pressure and load pressure. The load responsive control of the direction flow control valve blocks the pump flow to the motor while controlling negative load, providing the motor inlet with fluid from the motor exhaust.

14 Claims, 1 Drawing Figure

LOAD RESPONSIVE FLUID CONTROL VALVE

This is continuation-in-part of applications Ser. No. 729,696 filed Oct. 5, 1976 for "Load Responsive Fluid Control System" now U.S. Pat. No. 4,028,889, and Ser. No. 655,561 filed Feb. 5, 1976 for "Load Responsive Fluid Control System."

BACKGROUND OF THE INVENTION

This invention relates generally to load responsive fluid control valves and to fluid power system incorporating such valves, which systems are supplied by a single fixed or variable displacement pump. Such control valves are equipped with an automatic load responsive control and can be used in a multiple load system, in which a plurality of loads is individually controlled under positive and negative load conditions by separate control valves.

In more particular aspects this invention relates to direction and flow control valves capable of controlling simultaneously a number of loads under both positive and negative load conditions.

In still more particular aspects, this invention relates to direction and flow control valves capable of controlling simultaneously multiple positive and negative loads, which while controlling a negative load interrupt pump flow to the motor providing the motor inlet with fluid from the pressurized system exhaust.

Closed center load responsive fluid control valves are very desirable for a number of reasons. They permit load control with reduced power losses and therefore, increased system efficiency and when controlling one load at a time provide a feature of flow control irrespective of the variation in the magnitude of the load. Normally such valves include a load responsive control, which automatically maintains pump discharge pressure at a level higher, by a constant pressure differential, than the pressure required to sustain the load. A variable orifice, introduced between pump and load, varies the flow supplied to the load, each orifice area corresponding to a different flow level, which is maintained constant irrespective of variation in magnitude of the load. The application of such a system is, however, limited by one basic system disadvantage.

Normally in such a system the load responsive valve control can maintain a constant pressure differential and therefore constant flow characteristics when operating only one load at a time. With two or more loads, simultaneously controlled, only the highest of the loads will retain the flow control characteristics, the speed of actuation of lower loads varying with the change in magnitude of the highest load. A fluid control valve for such a system is shown in U.S. Pat. No. 3,488,953 issued to Haussler.

This drawback can be overcome in part by the provision of a proportional valve as disclosed in my U.S. Pat. No. 3,470,694 dated Oct. 7, 1969 and also in U.S. Pat. No. 3,455,210 issued to Allen on July 15, 1969. However, while these valves are effective in controlling positive loads they do not retain flow control characteristics when controlling negative loads, which instead of taking, supply the energy to the fluid system and hence the speed of actuation of such a load in a negative load system will vary with the magnitude of the negative load. Especially with so-called overcenter loads, where a positive load may become a negative load, such a valve will lose its speed control characteristics in the negative mode.

This drawback can be overcome by the provision of a load responsive fluid control valve as disclosed in my U.S. Pat. No. 3,744,517 issued July 10, 1973 and my U.S. Pat. No. 3,882,896 issued May 13, 1975. However, while these valves are effective in controlling both positive and negative loads, with pump pressure responding to the highest pressure of a system load being controlled, they utilize a controlling orifice located in the motor exhaust during negative load mode of operation and therefore control the fluid flow out of the fluid motor. These valves also during control of negative loads supply the motor inlet with throttled down fluid from the pump circuit, therefore using flow from the pump, while controlling a negative load. In certain fluid power control systems it is preferable, while controlling a negative load, to supply fluid to the motor inlet from the motor exhaust circuit instead of using pump capacity.

These drawbacks can be overcome in part by provision of fluid control valves as disclosed in U.S. Pat. No. 3,807,447 issued to Masuda on Apr. 30, 1974. However, while these valves utilize actuator exhaust fluid for actuator inlet flow requirement when controlling negative loads and also utilize a controlling orifice located between the pump and the actuator while controlling positive and negative loads, they regulate actuator inlet pressure by bypassing fluid to a down stream load circuit. Masuda's valves and their proportional control system are based on a series type circuit in which excess fluid flow is successively diverted from one valve to the other and in which loads arranged in series determine the system pressure. In such a system flow to the last valve operating a load must be delivered through all of the bypass sections of all of the other system valves, resulting in fluid throttling loss. These valves are not adaptable to simultaneous control of multiple loads in parallel circuit and they do not provide system load control pressure signal to the pump flow control mechanism.

SUMMARY OF THE INVENTION

It is therefore a principal object of this invention to provide improved load responsive fluid direction and flow control valves which block system pump from motor inlet and supply it with system exhaust flow when controlling negative loads, while transmitting control signals to system pump to maintain the pressure of the system pump higher, by a constant pressure differential, than the highest pressure of the system positive load being controlled.

Another object of this invention is to provide load responsive fluid direction and flow control valves, which load responsive fluid direction and flow control valves are provided with a pressurized exhaust manifold, flow from which supplies the inlet flow requirements of motors controlling negative loads.

It is a further object of this invention to provide load responsive fluid direction and flow control valves which retain their control characteristics during control of positive loads, while responding to a pressure differential developed across a variable orifice located between the pump and the actuator and which retain their control characteristics during control of negative loads while responding to a pressure differential developed across a variable orifice located between actuator and exhaust manifold.

Briefly the foregoing and other additional objects and advantages of this invention are accomplished by providing a novel load responsive fluid control system for use during proportional simultaneous control of multiple positive and negative loads. A system pump is controlled in respect to pressure signal transmitted from system valves, corresponding to the highest system load pressure. The exhaust circuit of the system is pressurized, the exhaust flow being used to provide inlet flow requirements of motors controlling negative loads. Valve controls during control of positive and negative loads respond to pressure differentials developed across variable orifices in the actuator inlet and outlet.

Additional objects of this invention will become apparent when referring to the preferred embodiments of the invention as shown in the accompanying drawing and described in the following detailed description.

DESCRIPTION OF THE PREFERRED EMBODIMENT

Figure 1:
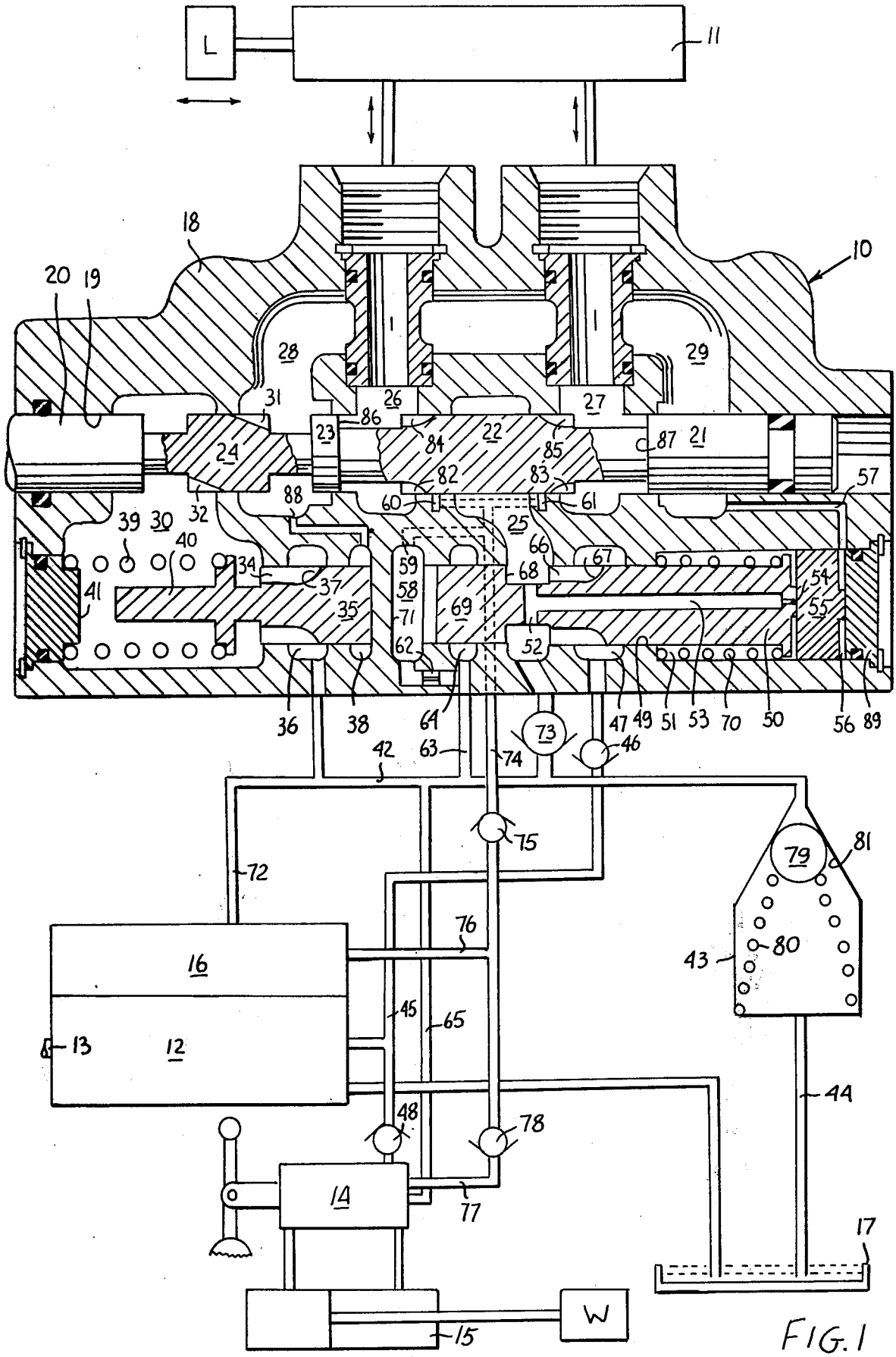
FIG. 1 is a longitudinal sectional view of an embodiment of a flow control valve having a positive load control responsive to actuator upstream pressure differential and negative load controls responsive to actuator down stream pressure differential for use in load responsive fluid control system, with lines, system flow control, system pump, second load responsive valve, exhaust relief valve and system reservoir shown diagrammatically.

Referring now to FIG. 1, an embodiment of a flow control valve, generally designated as 10, is shown interposed between diagrammatically shown fluid motor 11 driving load L and a pump 12 of a fixed displacement or variable displacement type driven through a shaft 13 by a prime mover not shown.

Similarly, a flow control valve 14, indentical to flow control valve 10, is interposed between a diagrammatically shown fluid motor 15 driving a load W and the pump 12. Fluid flow from the pump 12 to flow control valves 10 and 14 is regulated by a pump flow control 16. If pump 12 is of a fixed displacement type pump flow control 16 is a differential pressure relief valve, which in a well known manner, by bypassing fluid from the pump 12 to a reservoir 17, maintains discharge pressure of pump 12 at a level, higher by a constant pressure differential, than load pressure developed in fluid motor 11 or 15. If pump 12 is of a variable displacement type pump flow control 16 is a differential pressure compensator, well known in the art, which by changing displacement of pump 12 maintains discharge pressure of pump 12 at a level, higher by a constant pressure differential, than load pressure developed in fluid motor 11 or 15.

The flow control valve 10 is of a fourway type and has a housing 18 provided with a bore 19 axially guiding a valve spool 20. The valve spool 20 is equipped with lands 21, 22, 23 and outlet metering land 24 which in neutral position of the valve spool 20, as shown in FIG. 1 isolate a fluid supply chamber 25, load chambers 26 and 27, outlet chambers 28 and 29 and fluid unloading chamber 30. The metering land 24 is equipped with metering slots 31 and 32, which upon displacement of the metering land 24, from neutral position in either direction, connects for fluid flow the outlet chamber 28 with the unloading chamber 30. The unloading chamber 30 is connected through slots 34, of a negative load control spool 35, to the exhaust chamber 36. The negative load control spool 35 having slots 34, provided with throttling edges 37, projects into control space 38 and is biased towards a position, as shown, by spring 39. The negative load control spool 35 is provided with stop 40 limiting its displacement against surface 41. The exhaust chamber 36 in turn is connected through exhaust line 42, an exhaust relief valve, generally designated as 43, and line 44 to the reservoir 17.

The pump 12 through its discharge line 45 and load check valve 46 is connected to a fluid inlet chamber 47. Similarly discharge line 45 is connected through load check valve 48 with the inlet chamber of the fluid control valve 14. The control bore 49 connects the fluid inlet chamber 47 with the fluid supply chamber 25. The control spool 50, axially slidable in the control bore 49, projects on one end into space 51 connected to the fluid supply chamber 25 by passages 52 and 53 and restriction orifice 54 and abuts against piston 55 defining space 56 connected by passage 57 to outlet chamber 29. The control spool 50 on the other end projects into control space 58 which is connected by passage 59 with the positive load sensing ports 60 and 61 and through leakage orifice 62 and line 63 to a second exhaust chamber 64 and to upstream pressure of the exhaust relief valve 43. Similarly control space and leakage orifice of the control valve 14 is connected by line 65 to the upstream pressure of exhaust relief valve 34. The control spool 50 is provided with slots 66 terminating in throttling edges 67 and a sealing land 69 equipped with control surface 68, isolating the control space 58, the supply chamber 25 and the second exhaust chamber 64. The control spool 50 is biased by a control spring 70 towards position, in which slots 66 connect the fluid supply chamber 25 with the fluid inlet chamber 47. The control spool 50 with its sealing land 69 having a control surface 68 isolates, in the position as shown in FIG. 1, the fluid supply chamber 24 from the second fluid exhaust chamber 64. Displacement of the sealing land 69 from right to left cross-connects through control surface 68 the fluid supply chamber 25 and the second fluid exhaust chamber 64, the maximum displacement of the control spool 50 being limited by surface 71.

If the pump 12 is of a fixed displacement type excess pump flow from the differential pressure relief valve or pump flow control 16 is delivered through line 72 to the exhaust line 42, which communicates with the exhaust chamber 36, the second exhaust chamber 64, a bypass check valve 73, the exhaust relief valve 43 and through line 65 with all of the exhaust passages of the flow control valve 14. The bypass check valve 73 is interposed between exhaust line 42 and the fluid supply chamber 25.

Positive load sensing ports 60 and 61, located between load chambers 26 and 27 and the supply chamber 25 and blocked in neutral position of valve spool 20 by land 22, are connected through signal passage 74, a check valve 75 and signal line 76 to the pump flow control 16. In a similar manner positive load sensing ports of flow control valve 14 are connected through line 77, a check valve 78 and signal line 76 to the pump flow control 16.

The exhaust relief valve, generally designated as 43, interposed between combined exhaust circuits of flow control valves 10 and 14 including bypass circuit of pump 12 and reservoir 17, is provided with a throttling member 79 biased by a spring 80 towards engagement with seat 81.

The land 22 of the valve spool 20 is equipped with signal slots 82 and 83 located in the plane of positive load sensing ports 60 and 61 and metering slots 84 and 85 which in a well known manner can be circumferentially spaced in respect to each other and in respect to the signal slots 82 and 83. Signal slots 82 and 83, in a well known manner, can be substituted by end surfaces of land 22. A suitable device is provided to prevent relative rotation of the spool 20 in respect to bore 19.

The preferable sequencing of the control spool 50 is such that when moved from right to left, when throttling edges 67 close communication between the inlet chamber 47 and the supply chamber 25, control surface 68 is positioned at the point of opening communication between the supply chamber 25 and the second exhaust chamber 64. Further movement of the control spool 50 from right to left will gradually establish full flow communication between the second exhaust chamber 64 and the supply chamber 25.

The sequencing of the lands and slots of valve spool 20 preferably is such that when displaced in either direction from its neutral position, as shown in FIG. 1, one of the load chambers 26 or 27 is first connected by the signal slot 82 or 83 to the positive load sensing port 60 or 61 while load chambers 26 and 27 are still isolated from the supply chamber 25 and the outlet chambers 28 and 29. Further displacement of the valve spool 20 from its neutral position connects load chamber 26 or 27 through timing surface 86 or 87 with outlet chamber 28 or 29, while land 22 still isolates the supply chamber 25 from load chambers 26 and 27 and metering land 24 still isolates outlet chambers 28 and 29 from the unloading chamber 30. Still further displacement of valve spool 20 will connect load chamber 26 or 27 through metering slots 84 or 85 with the fluid supply chamber 25 while metering land 24 will connect through metering slots 31 or 32 outlet chambers 28 and 29 with the unloading chamber 30.

As previously described the pump flow control 16, in a well known manner, will regulate fluid flow delivered from pump 12 to discharge line 45, to maintain the pressure in discharge line 45 higher, by a constant pressure differential, than the highest load pressure signal transmitted through the check valve system to the signal line 76. Therefore with valve spools of flow control valves 10 and 14 in their neutral position blocking positive load sensing ports 60 and 61, signal pressure input to the pump flow control 16 from the signal line 76 will be at minimum pressure level.

With pump 12 of a fixed displacement type started up the pump flow control 16 will bypass through line 72, exhaust line 42, the exhaust relief valve 43 and line 44 all of pump flow to the system reservoir 17 at minimum pressure level equivalent to preload in the spring 80, while automatically maintaining pressure in discharge line 45 at a constant pressure, higher by a constant pressure differential, than pressure in signal line 76 or pressure in exhaust line 42. Therefore all of pump flow is diverted by the pump flow control 16 to the low pressure exhaust circuit, as previously described, without being used by flow control valves 10 and 14. Since signal line 76 is connected by passage 59 with control space 58, which in turn is connected through leakage orifice 62 and line 63 to upstream of exhaust relief valve 43, the bypass pressure in the discharge line 45 will be higher, by a constant pressure differential, than the pressure in exhaust line 42, which equals the pressure setting of the exhaust relief valve 43. This pump bypass pressure transmitted through passages 52 and 53 and restriction orifice 54 to space 51 reacts on the cross-sectional area of control spool 50 and against the bias of control spring 70 moves the control spool 50 from right to left, closing with throttling edges 67 the passage between the inlet chamber 47 and the supply chamber 25. Supply chamber 25 is connected through bypass check valve 73 with pressure existing in exhaust line 42. The pressure setting of exhaust relief valve 43 is selected to provide the necessary pressure drop through metering slots 84 and 85 to maintain load chamber 26 or 27 at above atmospheric pressure.

With pump 12 of a variable displacement type, under working conditions, minimum flow to the system exhaust manifold, composed of lines 72, 65, exhaust line 42 and exhaust pressure relief valve 43, may have to be diverted from the pump 12, to maintain the system exhaust manifold pressurized. A pressure reducing type regulator can be used, which upon system exhaust manifold pressure dropping below the setting of the exhaust pressure relief valve 43, will throttle some of the pump discharge flow and supply it to the exhaust manifold, to maintain it at a certain preselected minimum pressure level.

Assume that the load chamber 26 is subjected to a positive load. The initial displacement of the valve spool 20 to the right will connect the load chamber 26 through signal slot 82 with positive load port 60, while lands 21, 22 and 23 still isolate the supply chamber 25, load chambers 26 and 27 and outlet chambers 28 and 29. As previously described positive load signal, transmitted from positive load sensing port 60, through signal passage 74, check valve system and signal line 76 to the pump flow control 16 will increase the pressure in discharge line 45 to a level, which is higher by a constant pressure differential than the load pressure signal. The load pressure, transmitted through passage 59 to control space 58, will move the positive load control spool 50 to the right, opening through slots 66 communication between the inlet chamber 47 and the supply chamber 25. Communication will be maintained between the supply chamber 25 and the inlet chamber 47, as long as the pump flow control 16 maintains a constant pressure differential between the pump discharge pressure and the positive load pressure.

Further displacement of the valve spool 20 to the right will connect through timing surface 87 the load chamber 27 with outlet chambers 28 and 29, while land 22 still isolates the load chamber 26 from the supply chamber 25 and the metering land 24 still isolates the outlet chamber 28 from the unloading chamber 30. Since the load chamber 27 is subjected to low pressure no change in position of the negative load control spool 35 will take place.

Still further displacement of the valve spool 20 to the right will connect the load chamber 26, through metering slot 84, with the supply chamber 25 and will also connect through metering slot 32 the outlet chamber 28 with the unloading chamber 30. In a manner as previously described, the pump flow control 16 will maintain a constant pressure differential across orifice, created by displacement of metering slot 84, the flow into the load chamber 26 being proportional to the area of the orifice and therefore displacement of the valve spool 20 from its and therefore displacement of the valve spool 20 from its neutral position and independent of the magnitude of the load L.

Assume that while controlling positive load L through the flow control valve 10, a higher positive load W is actuated through the flow control valve 15. Higher load pressure signal from the flow control valve 15 will be transmitted through the check valve system to the pump flow control 16, which will now maintain system pressure, higher by a constant pressure differential, than pressure generated by positive load W. In a manner as previously described, the pressure drop through metering slot 84 will increase, therefore increasing the pressure differential between space 51 and control space 58. The positive load control spool 50 will move into its modulating position, throttling with throttling edges 67 the fluid flowing from the inlet chamber 47 to the supply chamber 25, to maintain a constant pressure differential between the supply chamber 25 and the load chamber 26, thus controlling fluid flow through metering slot 84.

Assume that the load chamber 27 is subjected to a negative load L and that the valve spool 20 is displaced from its neutral position to the right while, as previously described, the positive load control spool 50 is maintained by the pump standby pressure in a position blocking communication between the inlet chamber 47 and the supply chamber 25. Initial displacement of the valve spool 20 will connect through signal slot 82 the load chamber 26 with the positive load sensing port 60. Since the load chamber 26 is subjected to low pressure neither the pump flow control 16 nor the positive load control spool 50 will react to it.

Further displacement of valve spool 20 will connect negative load pressure from load chamber 27 with outlet chambers 29 and 28, while the metering land 24 still isolates the outlet chamber 28 from the unloading chamber 30. Negative load pressure, from the outlet chamber 28 will be transmitted through passage 88 to control space 38, where reacting on the cross-sectional area of the negative load control spool 35 will move it against the bias of the spring 39, all the way to the left, blocking communication between the unloading chamber 30 and the exhaust chamber 36. The negative load pressure from the outlet chamber 29 will be transmitted through pasage 57 to space 56 where, reacting on the cross-sectional area of the piston 55, will generate a force moving the control spool 50, against biasing force of control spring 70, all the way to the left, with sealing land 69 coming in contact with surface 71. The control spool 50 will be maintained in this position by the piston 55 during control of negative load, isolating with throttling edges 67 the inlet chamber 47 from the supply chamber 25 and establishing full flow communication, by displacement of control surface 68 of the sealing land 69, between the second exhaust chamber 64 and the supply chamber 25.

Further displacement of valve spool 20 to the right will connect through metering slot 32 the outlet chamber 28 with the unloading chamber 30, while also connecting through metering slots 84 the load chamber 26 with the supply chamber 25. Since the unloading chamber 30 is isolated by position of the negative load control spool 35, the pressure in the unloading chamber 30 will begin to rise, until it will reach a level, at which force generated on the cross-sectional area of the negative load control spool 35, by the pressure in control space 38, will equal the sum of the force generated on the same cross-sectional area by the pressure in the unloading chamber 30 and the biasing force of the spring 39. At this point the negative load control spool 35 will move from left to right into a modulating position, in which fluid flow from the unloading chamber 30 to the exhaust chamber 36 will be throttled by the throttling edges 37, to automatically maintain a constant pressure differential, equivalent to baising force of the spring 39, between the outlet chamber 28 and the unloading chamber 30. Since during control of negative load a constant pressure differential is maintained across the orifice, created by the displacement of metering slot 32, by the throttling action of negative load control spool 35, fluid flow through metering slot 32 will be proportional to the displacement of the valve spool 20 and constant for each specific position of metering slot 32, irrespective of the change in the magnitude of the negative load L.

As previously described during control of negative load the control spool 50 will be maintained by the piston 55 in a position, where it isolates the inlet chamber 47 from the supply chamber 25, while establishing full flow communication between the second exhaust chamber 64 with the supply chamber 25. In this way, during control of negative load, the supply chamber 25 is connected through the second exhaust chamber 64, line 63 and exhaust line 42 to the total exhaust manifold of flow control valve 10 and 14, pressurized by the exhaust relief valve 43. The pressure setting of the exhaust relief valve 43 is high enough to provide the necessary pressure drop through metering slot 84, at the highest rates of flow from the supply chamber 25 to the load chamber 26, without pressure in the load chamber 26 dropping below atmospheric level, thus preventing any possibility of cavitation. In this way, during control of negative load, the inlet flow requirement of the actuator is not supplied from the pump circuit but from the pressurized exhaust circuit of flow control valves 10 and 14, conserving the pump flow and increasing system efficiency. If negative load pressure is not sufficiently high to provide a constant pressure drop through metering slot 32, the negative load control spool 35 will move the right from its modulating and throttling position, the negative load pressure in the outlet chamber 29 and space 56 will drop to a level at which the pressure in space 51, due to the setting of the exhaust relief valve 43, with the biasing force of control spring 70 will move the piston 55 to the right together with the control spool 50 and the control system will revert to its positive load mode of operation, providing the energy to load L from the pump circuit to maintain a constant pressure differential across metering slot 84, which will also maintain a constant pressure differential across metering slot 32. During control of negative load the inlet flow requirement of the actuator is supplied from the outlet flow from the actuator, bypass flow from pump flow control and the exhaust circuits of all of the other system flow control valves. During control of negative load system exhaust manifold is not only connected with the supply chamber through the second exhaust chamber but also through bypass check valve 73. The bypass check valve 73 is only needed in certain applications, in which a change from positive to negative load can occur at high rates of flow, like for example in a hydrostatic transmission circuit, well known in the art. For most of the applications controlling hydraulic cylinders the bypass check valve 73 can be dispensed with.

As shown in FIG. 1 the piston 55 is of a larger diameter than the control spool 50. If desired, in a well known manner, the piston 55 can be slidably mounted in a bore provided in plug 89 and be of the same or even smaller diameter than control spool 50. In FIG. 1 space 56 is connected by passage 57 to outlet chamber 29 and receives negative load pressure signal from the outlet chamber 29. Space 56 can be connected to negative load sensing ports located in the bore 19 between load and outlet chambers and be selectively communicable by the valve spool 20 with the negative load pressure existing in the load chambers.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A valve assembly supplied with pressure fluid by a pump, said valve assembly comprising a housing having a fluid inlet chamber, a fluid supply chamber, first and second load chambers, load pressure sensing means operable to transmit a control signal to said pump, and fluid exhaust means, first valve means for selectively interconnecting said fluid load chambers with said load pressure sensing means, said fluid supply chamber and said fluid exhaust means, variable metering orifice means responsive to movement of said first valve means and operable to throttle fluid flow between said fluid supply chamber and said load chambers, outlet fluid throttling means between said load chambers and said fluid exhaust means on said first valve means, second valve means having inlet fluid throttling means between said fluid inlet chamber and said fluid supply chamber responsive to pressure differential across said variable metering orifice means, said second valve means having inlet fluid isolating means between said fluid inlet chamber and said fluid supply chamber, said inlet fluid isolating means having means responsive to pressure upstream of said outlet fluid throttling means, and fluid replenishing means operable to supply fluid flow from said fluid exhaust means to one of said load chambers which is not pressurized when said fluid isolating means isolates said fluid supply chamber from said fluid inlet chamber.

2. A valve assembly as set forth in claim 1 wherein a second pressure sensing means in communication with actuating means of said inlet fluid isolating means is interposed between said load chambers and said fluid exhaust means, said second pressure sensing means being selectively communicable by said first valve means with said load chambers.

3. A valve assembly as set forth in claim 2 wherein said first valve means has blocking means to block said second pressure sensing means from said load chambers.

4. A valve assembly as set forth in claim 1 wherein said fluid replenishing means have fluid connecting means on said second valve means to connect said fluid supply chamber to said fluid exhaust means when said inlet fluid isolating means isolates said fluid supply chamber from said fluid inlet chamber.

5. A valve assembly as set forth in claim 1 wherein said second valve means have fluid throttling and inlet fluid isolating means.

6. A valve assembly as set forth in claim 1 wherein said fluid replenishing means has exhaust fluid pressurizing means in said fluid exhaust means.

7. A valve assembly as set forth in claim 6 wherein check valve means interconnects for one way fluid flow said exhaust fluid pressurizing means and said fluid load chamber which is not pressurized.

8. A valve assembly as set forth in claim 1 wherein said fluid replenishing means has interconnecting means to interconnect for fluid flow said fluid supply chamber and said fluid exhaust means when said fluid isolating means isolates said fluid supply chamber from said fluid inlet chamber.

9. A valve assembly as set forth in claim 8 wherein said interconnecting means has check valve means to interconnect for one way fluid flow said fluid exhaust means and said fluid supply chamber.

10. A valve assembly as set forth in claim 1 wherein said inlet fluid throttling means has means operable to control fluid flow from said fluid inlet chamber to said fluid supply chamber to maintain said pressure differential across said variable metering orifice means at a relatively constant level when one of said load chambers is interconnected with said fluid supply chamber and said load chamber is pressurized.

11. A valve assembly as set forth in claim 1 wherein said first valve means has said outlet fluid throttling means operable to throttle fluid flow between said load chambers and said fluid exhaust means, and a third valve means responsive to pressure differential across said outlet fluid throttling means and operable to maintain said pressure differential constant when one of said load chambers is connected to said exhaust means and said load chamber is pressurized.

12. A valve assembly as set forth in claim 1 wherein said load pressure sensing means includes control signal check valve means.

13. A valve assembly as set forth in claim 12 wherein said load pressure sensing means has leakage orifice means upstream of said control signal check valve means.

14. A valve assembly supplied with pressure fluid by a pump, said valve assembly comprising a housing having a fluid inlet chamber, a fluid supply chamber, first and second load chambers, load pressure sensing means operable to transmit a control signal to said pump, and fluid exhaust means, first valve means for selectively interconnecting said fluid load chambers with said load pressure sensing means, said fluid supply chamber and said fluid exhaust means, first variable metering orifice means responsive to movement of said first valve means and operable to throttle fluid flow between said fluid supply chamber and said load chambers, second variable metering orifice means responsive to movement of said first valve means and operable to throttle fluid flow between said load chambers and said exhaust means, second valve means having inlet fluid isolating means between said fluid inlet chamber and said fluid supply chamber, said second valve means having means responsive to pressure differential between said first and second load chambers operable to isolate said fluid inlet chamber from said load chambers when one of said load chambers is interconnected to said exhaust means by said first valve means and said load chamber is pressurized, and fluid replenishing means operable to supply fluid flow from said fluid exhaust means to one of said load chambers which is not pressurized when said fluid isolating means isolates said fluid inlet chamber from said fluid load chambers.

* * * * *